US007784959B2

(12) United States Patent
Yang

(10) Patent No.: US 7,784,959 B2
(45) Date of Patent: Aug. 31, 2010

(54) WHIRLPOOL TYPE AQUA-LAMP-BASED CANDLE-LIKE LIGHTING DEVICE

(76) Inventor: Chin-Sheng Yang, 4F., No. 26, Lane 358, Yung-An St., Tainan City (TW)

( * ) Notice: Subject to any disclaimer, the term of this patent is extended or adjusted under 35 U.S.C. 154(b) by 147 days.

(21) Appl. No.: 12/241,079

(22) Filed: Sep. 30, 2008

(65) Prior Publication Data

US 2009/0135586 A1 May 28, 2009

(30) Foreign Application Priority Data

Nov. 22, 2007 (TW) ..... 96219759 U

(51) Int. Cl.
*F21V 33/00* (2006.01)
*F21V 5/00* (2006.01)

(52) U.S. Cl. ..... 362/101; 362/96; 362/318; 362/810

(58) Field of Classification Search ..... 362/96, 362/101, 810, 569, 269, 271, 272, 318
See application file for complete search history.

(56) References Cited

U.S. PATENT DOCUMENTS 5,065,289 A * 11/1991 Teng ..... 362/101
6,877,883 B2 * 4/2005 Lau Ting Yup et al. ..... 362/363
2003/0202340 A1 * 10/2003 Wu ..... 362/101
2006/0215397 A1 * 9/2006 Lee ..... 362/161

* cited by examiner

*Primary Examiner*—Jong-Suk (James) Lee
*Assistant Examiner*—David R Crowe
(74) *Attorney, Agent, or Firm*—Leong C. Lei

(57) ABSTRACT

A whirlpool type aqua-lamp-based candle-like lighting device includes a stand accommodating therein a motor for driving rotation of a magnetic piece and an aqua lamp that defines a chamber mounted to an open end of the stand. The aqua lamp receives therein a magnetically-driven moving piece located on a bottom thereof and corresponding to the magnetic piece and a light generation assembly is set under the aqua lamp. An illuminator for generating twinkling lighting is arranged at an opening of the chamber. Thus, the motor, once set in operation, rotates the magnetically-driven moving piece, which in turn causes a liquid flow inside the aqua lamp in a whirlpool and dazzling/shining manner; meanwhile, the illuminator on the chamber provides a function of simulating a twinkling candle flaming. The whirlpool type aqua-lamp-based candle-like lighting device shows dual interests of visual effects in light twinkling and entertainment of observing liquid flowing.

7 Claims, 3 Drawing Sheets

WHIRLPOOL TYPE AQUA-LAMP-BASED CANDLE-LIKE LIGHTING DEVICE

TECHNICAL FIELD OF THE INVENTION

The present invention generally relates to a whirlpool type aqua-lamp-based candle-like lighting device, and particularly to a whirlpool type aqua-lamp-based candle-like lighting device that features dual interests of twinkling light visual effect and entertainment of observing flowing liquid, which are realized by means of stand that supports an aqua lamp in which liquid flowing in a whirlpool fashion is induced and an illuminator.

DESCRIPTION OF THE PRIOR ART

Lighting devices are commonly used for general household lighting and besides such lighting devices, other lighting tools, such as table lamp and socket-plugged miniature candle-like lighting units, which are measures used to light a limited area around the lighting unit and to provide decoration for enhanced romantic atmosphere. Various of candle-like lighting device or other lighting devices for similar purposes are available in the market and they are of versatile designs, often depending upon the material used. A light source contained in such lighting devices can be a standard lamp bulb or light-emitting diode, or even a power-saving bulb/tube. Yet, all these variations are limited to the lighting and decoration related fields, and as such, the development of the candle-like lighting is subjected to limitation, making them no match to large-sized lighting devices that are of various designs subjected to substantially no limitation. A solution to overcome such a drawback is to combine interesting functions, other than simply lighting and decoration, to the candle-like lighting to make a breakthrough of the existing outside visual effect, by which attraction to the general consumers can be improved.

Based on years' experience in development and manufacturing of pendant lighting and a strong love for aqua lamp, the present applicant wishes to provide a whirlpool type aqua-lamp-based candle-like lighting device that, besides lighting in the nighttime, provides an additional censing or perfuming effect. With successive attempts in the development of such a device, a whirlpool type aqua-lamp-based candle-like lighting device is invented and will be further described hereinafter.

SUMMARY OF THE INVENTION

Thus, the present invention provides a whirlpool type aqua-lamp-based candle-like lighting device comprising a stand accommodating therein a motor for driving rotation of a magnetic piece and an aqua lamp that defines an internal chamber mounted to an open end of the stand. The aqua lamp receives therein a magnetically-driven moving piece located on a bottom thereof and corresponding to the magnetic piece and a light generation assembly is set under the aqua lamp. An illuminator for generating twinkling lighting is arranged at an opening of the chamber. Thus, the motor, once set in operation, rotates the magnetically-driven moving piece, which in turn causes a liquid flow inside the aqua lamp in a whirlpool and dazzling/shining manner; meanwhile, the illuminator on the chamber provides a function of simulating a twinkling candle flaming. As such, the whirlpool type aqua-lamp-based candle-like lighting device shows dual interests of visual effects in both light twinkling and entertainment of observing liquid flowing.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
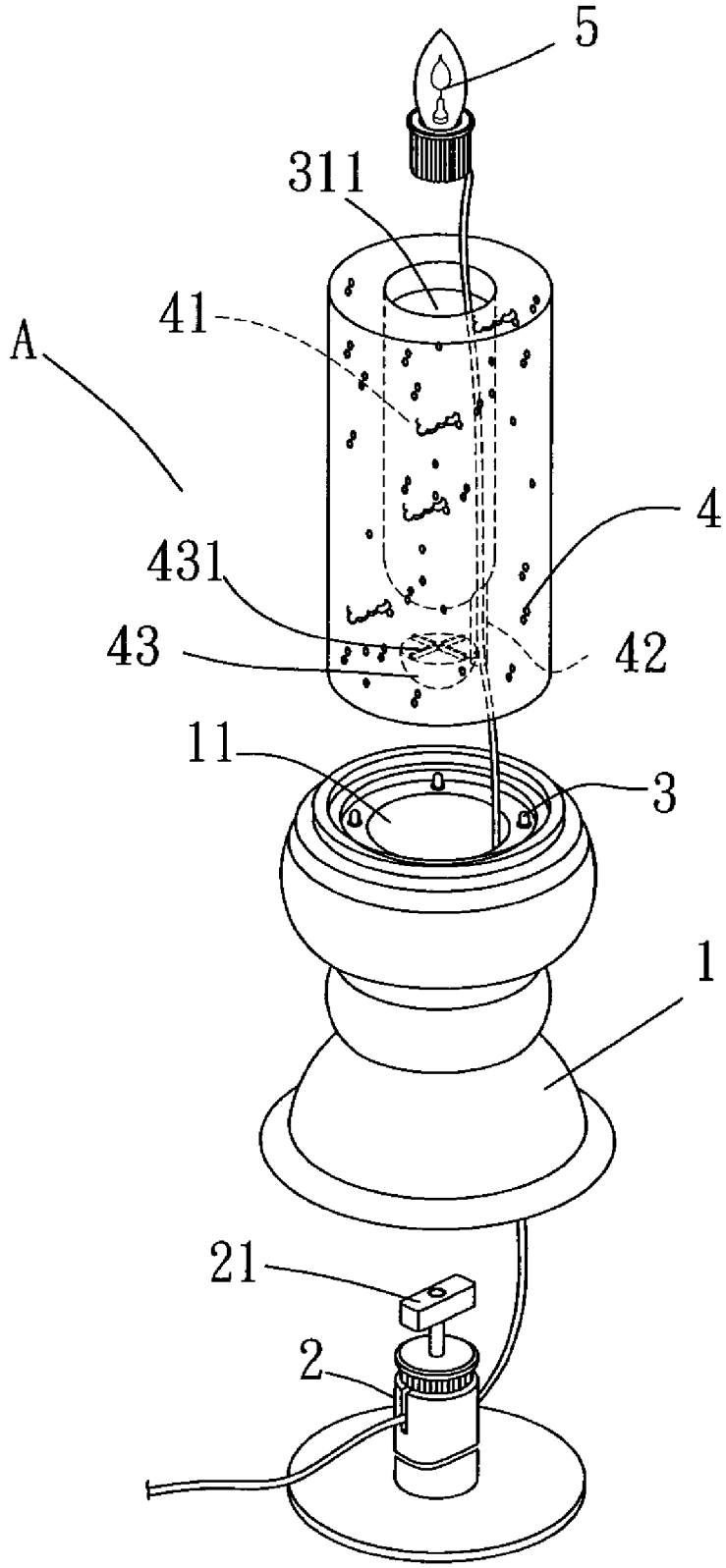
FIG. 1 is an exploded view of a whirlpool type aqua-lamp-based candle-like lighting device in accordance with the present invention.

With initial reference to FIG. 1, which illustrates an exploded view of a whirlpool type aqua-lamp-based candle-like lighting device constructed in accordance with the present invention, the aqua-lamp-based candle-like lighting device A generally comprises the following constituent parts/components:

A stand 1 comprises a hollow structure forming an open end 11.

A motor 2 is mounted inside the stand 1 and has a spindle having an end to which a magnetic piece 21 is mounted.

A light generation assembly 3 comprises at least one lighting element, such as light-emitting diode (LED) set along a circumference of the open end 11 of the stand 1.

A light-transmittable aqua-lamp base 4 comprises a three-dimensional and light-transmittable structure forming centrally an internal chamber 41 that is surrounded by a flowable liquid. A passage 42 is defined through the light-transmittable aqua-lamp base 4 in communication with the chamber 41 at a location corresponding to the open end 11 of the stand 1. If desired, the flowable liquid may be mixed with flake- or particle-like spangles. The aqua-lamp, as a whole, is mounted to the open end 11 of the stand 1 and located above the light generation assembly 3. The aqua-lamp base 4 contains therein a magnetically-driven moving piece 43 at the bottom thereof corresponding to the magnetic piece 21.

An illuminator 5 is mounted at an open end 411 of the internal chamber 41 of the aqua-lamp base 4 and is electrically connected to the motor 2 through the passage 32 to be supplied with power for generating lighting.

Figure 2:
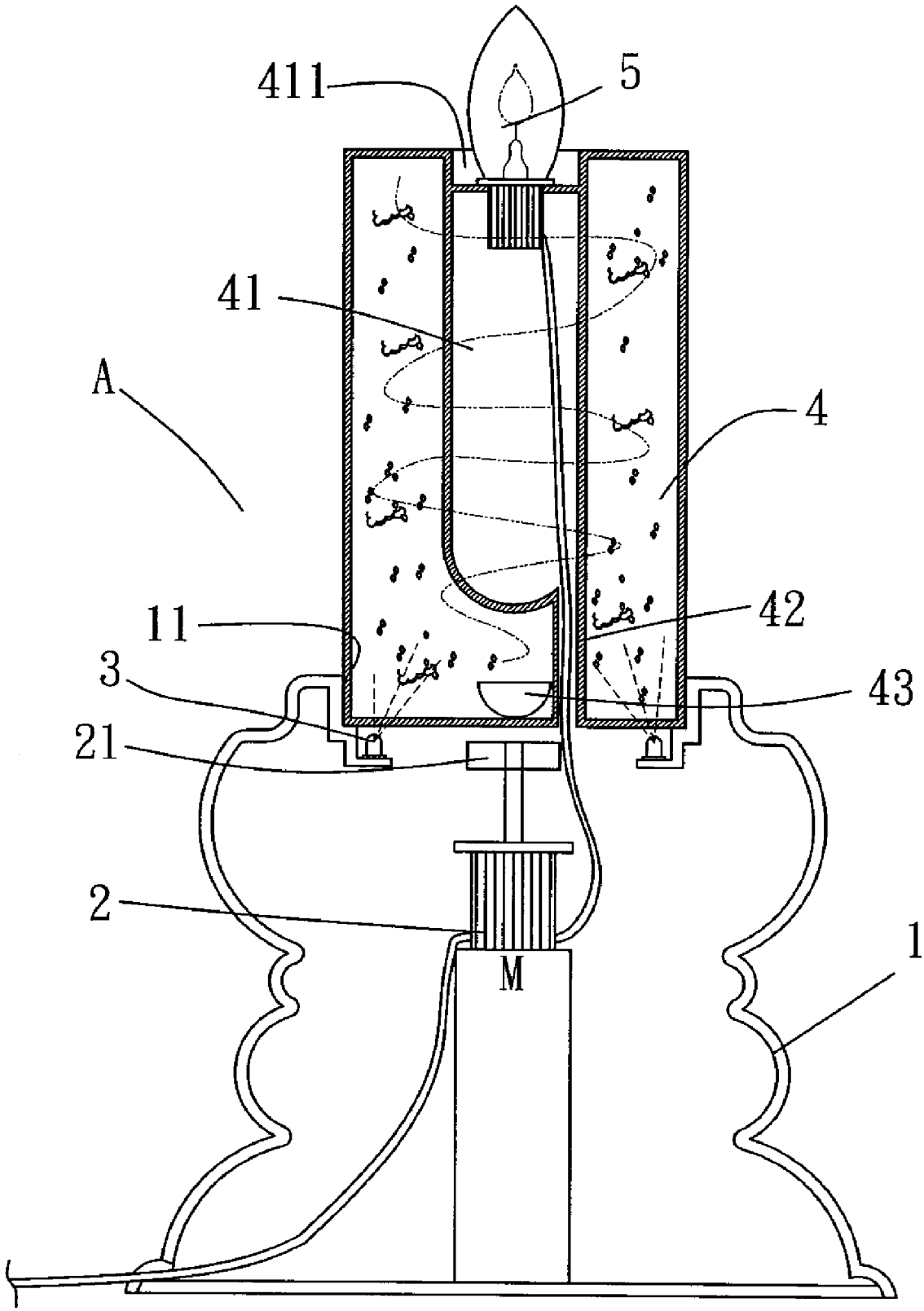
FIG. 2 is a cross-sectional view of the whirlpool aqua-lamp-based candle-like lighting device of the present invention.

Also referring to FIG. 2, which shows a cross-sectional view of the whirlpool type aqua-lamp-based candle-like lighting device in accordance with the present invention, the aqua-lamp-based candle-like lighting device A of the present invention is formed by first electrically connecting the motor 2 inside the stand 1 to a power source to have the motor 2 energized for rotation that drives the magnetic piece 21 to rotate in unison therewith. In the meanwhile, the power is also supplied to the light generation assembly 3 to generate light. When the magnetic piece 21 rotates, due to magnetism, the magnetically-driven moving piece 43 inside the aqua-lamp base 4 is caused to rotate and such a rotation of the moving piece 43 in turn causes the liquid to flow in a whirlpool fashion, which together with the lighting provided by the light generation assembly 3 provides a more enhanced shining/dazzling effect. Further, the flow of the liquid brings the spangles to shift and float. As such, a shining and interesting whirlpool type aqua lamp is realized. Further, fins 431 can be extended upward from the magnetically-driven moving piece 43 for facilitating the flow of liquid inside the aqua-lamp base 4, making more shining and prominent whirlpool of liquid flowing.

Further, when the motor 2 is powered on, the illuminator 5 is also energized to give off twinkling light, so that the illuminator 5 generates twinkling lighting at the open end 411 of the internal chamber 41 similar to candle lighting. An inside surface of the chamber 41 is preferably coated with a colored layer to shield electrical wire or cable extending from the internal space to the illuminator 5 and to make the light that transmits through and prorogates outwards from the aqua-lamp base 4 showing a gradually-changed multi-layer-like brightness. The illuminator 5 can be for example a regular lamp bulb or a light-emitting diode, or alternately, the illuminator 5 is a twinkling bulb, which provides lighting/darkening-alternating lighting effect so as to more closely mimic candle lighting.

Figure 3:
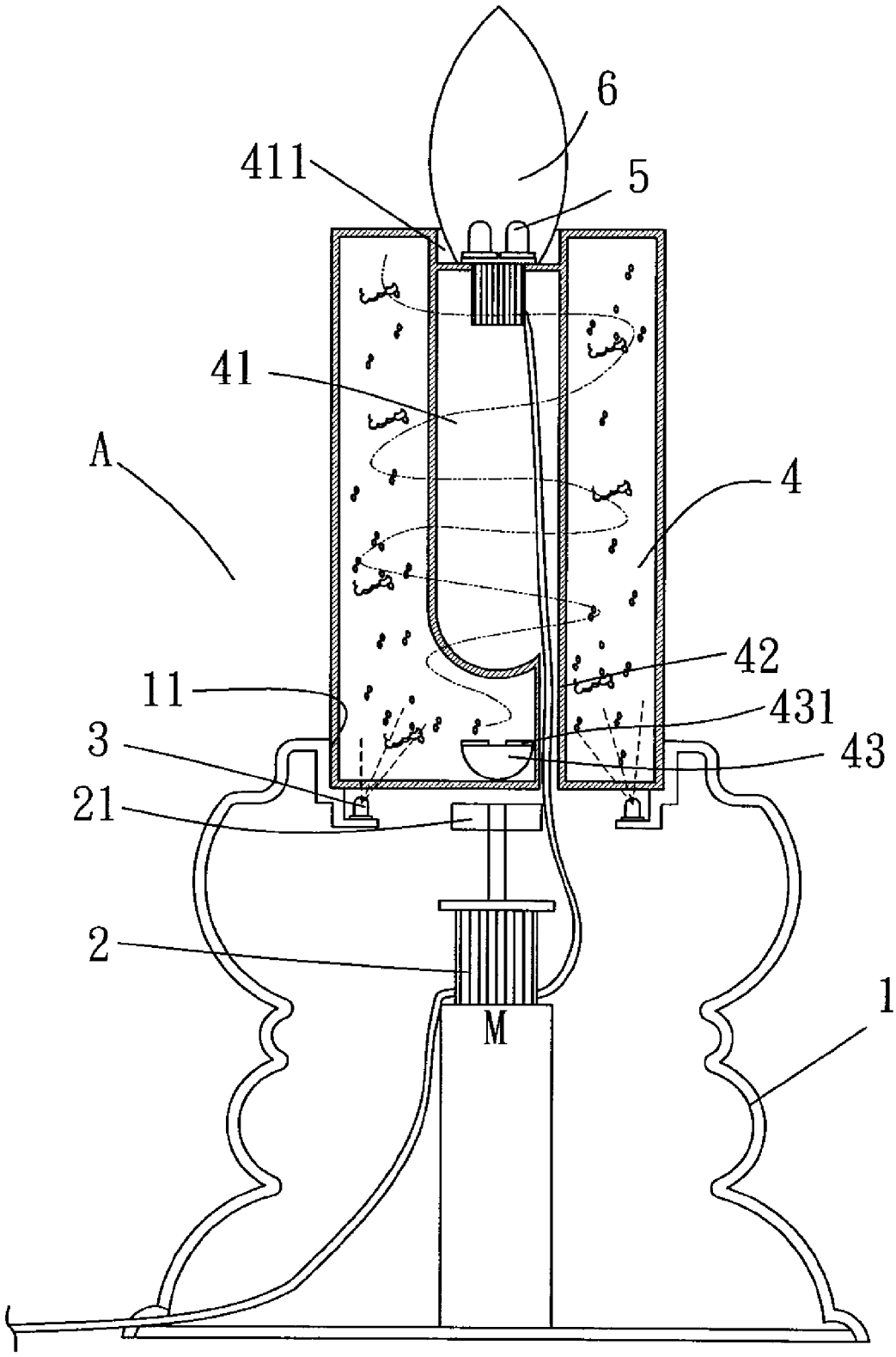
FIG. 3 is a cross-sectional view of the whirlpool type aqua-lamp-based candle-like lighting device in accordance with a modified embodiment of the present invention.

Also referring to FIG. 3, a flame-like shade 6 is mounted to the aqua-lamp base 4 at a location corresponding to the light-emitting diode of the illuminator 5. Fitting the shade 6 outside the light-emitting diode mimics a flaming candle, and the lighting provided by the light-emitting diode make the whole lighting device more beautiful and attractive.

From the above description of the constituent parts and operation of the whirlpool type aqua-lamp-based candle-like lighting device of the present invention, several advantages can be recognized and will be briefed as follows:

(1) The whirlpool type aqua-lamp-based candle-like lighting device of the present invention comprises a stand that receives and fixes therein a motor that rotates a magnetic piece to drives a magnetically-driven moving piece for causing a whirlpool of liquid flowing inside an aqua-lamp base to show gradually-changed and layered shining and interesting candle lighting.

(2) The whirlpool type aqua-lamp-based candle-like lighting device of the present invention comprises an illuminator arranged in the light-transmittable aqua-lamp base to provide a visual effect of twinkling lighting in the nighttime.

(3) Based on the above two points, the stand of the whirlpool type aqua-lamp-based candle-like lighting device of the present invention is provided with the magnetically-driven moving piece that is rotated by means of magnetism to generate a whirlpool of liquid flow inside the aqua-lamp base and also comprises the illuminator arranged in the light-transmittable aqua-lamp base to provide dual interests of visual effects in gradually-changed layered lighting and liquid flowing.

(4) The whirlpool aqua-lamp-based candle-like lighting device of the present invention comprises a flame-like shade fit over the light-emitting diode of the illuminator, which mimics a flaming candle, so that the aqua-lamp-based candle-like lighting device of the present invention as a whole is more similar to the aesthetic visual effect that a candle can provide.

To conclude, the above description of the integral formation of the structure in accordance with the embodiment of the present invention reveals that the present invention does perfectly exhibit the functionality of the whirlpool type aqua-lamp-based candle-like lighting device and that, based on co-existence of the illuminator and the magnetic piece, the present invention provides dual interprets of visual effects in night lighting and entertainment.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A whirlpool type aqua-lamp-based candle-shaped lighting device, comprising:

a stand, which comprises a hollow structure forming an open end;

a motor, which is fixed inside the stand and has a spindle to which a magnetic piece is mounted;

a light generation assembly, which is mounted along a circumference of the open end of the stand;

a light-transmittable aqua-lamp base, which comprises a three-dimensional and light-transmittable structure forming an internal chamber, the chamber is surrounded by a flowable liquid, the aqua-lamp base further comprising a passage being defined through the aqua-lamp base in communication with the chamber and set at a location corresponding to the open end of the stand, the aqua-lamp base being mounted to the open end of the stand and located above the light generation assembly, a magnetically-driven moving piece being arranged in the aqua-lamp base at a bottom thereof corresponding to the magnetic piece; and an illuminator, which is mounted at an open end of the internal chamber of the aqua-lamp base, the illuminator is electrically connected with the motor by a wire passing through the internal chamber and the passage, in order to generate light;

whereby when the motor is set in operation to make the magnetically-driven moving piece rotate, the liquid inside the aqua-lamp base is caused to flow in a whirlpool fashion, and the light generation assembly projects dazzling lighting and the illuminator generates twinkling lighting.

2. The whirlpool type aqua-lamp-based candle-like lighting device according to claim 1, wherein the flowable liquid contains flake-like spangles.

3. The whirlpool type aqua-lamp-based candle-like lighting device according to claim 1, wherein the light generation assembly comprises a light-emitting diode.

4. The whirlpool type aqua-lamp-based candle-like lighting device according to claim 1, wherein the illuminator comprises a light-emitting diode.

5. The whirlpool type aqua-lamp-based candle-like lighting device according to claim 1, wherein the illuminator comprises a twinkling bulb.

6. The whirlpool type aqua-lamp-based candle-like lighting device according to claim 1, wherein the magnetically-driven moving piece forms fins extending upward therefrom for guiding the liquid flow.

7. The aqua-lamp-based candle-like lighting device according to claim 1, wherein the internal chamber has an inside surface that is coated with a colored layer.

* * * * *